US005221324A

United States Patent [19]

Jin et al.

[11] Patent Number: 5,221,324

[45] Date of Patent: Jun. 22, 1993

[54] LIGHTWEIGHT METAL WITH ISOLATED PORES AND ITS PRODUCTION

[75] Inventors: Iljoon Jin, Kingston; Lorne D. Kenny, Inverary; Harry Sang, Kingston, all of Canada

[73] Assignee: Alcan International Limited, Montreal, Canada

[21] Appl. No.: 908,581

[22] Filed: Jun. 29, 1992

Related U.S. Application Data

[63] Continuation of Ser. No. 754,922, Sep. 4, 1991, abandoned, which is a continuation-in-part of Ser. No. 573,716, Aug. 27, 1990, Pat. No. 5,112,697, which is a continuation-in-part of Ser. No. 403,588, Sep. 6, 1989, Pat. No. 4,973,358.

[51] Int. Cl.[5] ..... B22D 27/00

[52] U.S. Cl. ..... 75/415; 428/593

[58] Field of Search ..... 75/415; 428/614, 593

[56] References Cited

U.S. PATENT DOCUMENTS 3,297,431 1/1967 Ridgway ..... 75/415

4,713,277 12/1987 Akiyama et al. ..... 75/415

4,713,277 12/1987 Akiyama et al. ..... 428/131

4,973,358 11/1990 Jin et al. ..... 75/415

*Primary Examiner*—Melvyn J. Andrews

*Attorney, Agent, or Firm*—Cooper & Dunham

[57] ABSTRACT

A novel lightweight gas metal composite is produced having isolated particle stabilized pores. A composite of a metal matrix, e.g. aluminum, and finely divided solid stabilizer particles, e.g. silicon carbide, is heated above the liquidus temperature of the metal matrix and this is mixed such that a vortex is formed. The molten composite is blanketed with a gas and during the vortex mixing. This gas is drawn into the melt to produce an expanded, viscous molten composite material containing pores which are very small, spherical-shaped and quite evenly distributed. The viscous molten composite material can be directly formed into a solid shaped product and is also capable of being remelted and formed by forming processes without destroying the integrity of the pores. The result is a lightweight expanded metal product capable of being formed into shapes to close dimensional tolerances.

23 Claims, 3 Drawing Sheets

10x

100x

4x

25x

LIGHTWEIGHT METAL WITH ISOLATED PORES AND ITS PRODUCTION

CROSS REFERENCE TO RELATED APPLICATIONS

This application is a continuation of copending U.S. patent application Ser. No. 754,922, filed Sep. 4, 1991 now abandoned, which is a continuation in part of U.S. patent application Ser. No. 573,716, filed Aug. 27, 1990, now U.S. Pat. No. 5,112,697, which is in turn a continuation in part of U.S. patent application Ser. No. 403,588, filed Sep. 6, 1989, now U.S. Pat. No. 4,933,358.

BACKGROUND OF THE INVENTION

This invention relates to a lightweight gas-metal composite with isolated particle-stabilized pores, particularly a lightweight aluminum composite, and its production.

Lightweight foamed metals have high strength-to-weight ratios and are extremely useful as load-bearing materials and as thermal insulators. Metallic foams are characterized by high impact energy absorption capacity, low thermal conductivity, good electrical conductivity and high absorptive acoustic properties.

Foamed metals have been described previously, e.g. in U.S. Pat. Nos. 2,895,819, 3,300,296 and 3,297,431. In general such foams are produced by adding a gas-evolving compound to a molten metal. The gas evolves to expand and foam the molten metal. After foaming, the resulting body is cooled to solidify the foamed mass thereby forming a foamed metal solid. The gas-forming compound can be metal hydride, such as titanium hydride, zirconium hydride, lithium hydride, etc. as described in U.S. Pat. No. 2,983,597.

A recent development in the production of lightweight foamed metal is described in Jin, U.S. Pat. No. 4,973,358, issued Nov. 27, 1990. In that patent, a composite of a metal matrix and finely divided solid stabilizer particles was heated above the liquidus temperature of the metal matrix and gas bubbles were discharged into the molten metal composite below the surface to thereby form a foamed melt on the surface of the molten metal composite. When this foam was cooled, it formed a solid foamed metal having a plurality of closed cells. The cells of this foam were large and had a polygonal structure with quite thin walls between the cells. Such foams in the liquid state are not amenable to shape casting and forming, since the applied forces tend to breakup the fragile cell structure. For example, it is difficult to conformably fill an open mold with this material. Even gentle urgings with a spatula or a similar tool tends to destroy the foam.

It is the object of the present invention to produce a lightweight gas-metal composite which is capable of being subjected to forming procedures without destroying its structural integrity.

SUMMARY OF THE INVENTION

According to the present invention, a composite of a metal matrix and finely divided solid stabilizer particles is heated above the liquidus temperature of the metal matrix. The molten metal composite is then vigorously mixed such that a vortex is formed. Gas on the surface of the molten metal composite is by way of the action of the vortex drawn into the molten composite. The gas is drawn in as mixing continues such that the hot molten metal composite eventually forms into an expanded material having a pasty or viscous consistency. The gas is distributed throughout this expanded, viscous material in the form of small isolated pores.

This expanded, viscous metal composite material when still above the liquidus temperature of the metal behaves in a very different manner than does the stabilized liquid foam described in U.S. Pat. No. 4,973,358. Thus, the hot expanded, viscous material of this invention does not breakup upon the application of an external force. This is so even after the composite has been allowed to stand in the molten condition for an extended period of time (e.g. up to 72 hrs). It is believed that in the interior of the material, the forces are mainly hydrostatic in nature such that only negligible shearing forces occur. However, on the surface the shearing forces are quite strong and the porous structure is destroyed. The result, is a product having a porous interior structure and a smooth exterior skin.

Any of the usual techniques normally applied to either liquids or solids exclusively can be used to shape the small pore three-phase mixtures of this invention. For instance, die-casting may be used, which is normally utilized only with liquids. It is also possible to use thixotropic shaping techniques (M. C. Flemings, Rheocasting, Pages 4241 to 4243 Encyclopedia of Material Sciences and Engineering. Edited by M. B. Bever. Published by Pergamon Press, 1986), such as thixo-extrusion or thixo-forging.

Also, surprisingly the expanded metal product of this invention can be allowed to solidify and can be remelted for forming into a shaped product without breakdown of the expanded structure.

In the products of the present invention, the pores are generally spherical and are widely dispersed within the matrix. These pores typically have diameters in the range of 10–500 microns and these are relatively uniformly spaced through the matrix with substantial amounts of matrix material between the pores. In a typical structure, there are widely spaced pores of large diameter with pores of small diameter in the matrix material between the large pores.

The spacing between pores is an average at least 50 microns and typically 100 microns or more. It is an important feature of the present invention that there be a substantial mass of metal composite between the pores. Thus, the product preferably has a relative density ($P^*/P_s$) of about 0.3 to $\leqq 1$, where $P^*$ is the density of the porous material and $P_s$ is the density of the solid composite.

A wide variety of refractory materials may be used as the finely divided solid stabilizer particles. The main requirements of such particles are that they be capable of being incorporated in and distributed throughout the metal matrix and being capable of at least substantially maintaining their integrity as incorporated rather than losing their form or identity by dissolution in or by extensive chemical combination with the metal matrix.

Examples of suitable solid stabilizer materials include alumina, titanium diboride, zirconia, silicon carbide, silicon nitride, etc. The volume fraction of particles in the foam is typically less than 25% and is preferably in the range of about 5 to 15%. The particle sizes can range quite widely, e.g. from about 0.1 to 50 μm, but generally particle sizes will be in the range of about 0.5 to 25 μm with a particle size range of about 1 to 20 μm being preferred.

The metal matrix may consist of a wide variety of metals capable of being mixed in the molten state by vortex mixing. Examples of these include aluminum, magnesium, steel, zinc, lead, nickel, copper and alloys thereof. Of particular interest are standard wrought, cast or other aluminum alloys, for example alloys available under Aluminum Association (AA) designations 6061, 2024, 7075, 7079 and A 356.

The gas forming the pores may typically be selected from the group consisting of air, carbon dioxide, oxygen, inert gases, etc. Because of its ready availability, air is usually preferred.

The mixing may be done by any means capable of producing a vortex. For instance a mechanical impeller or an electromagnetic mixing system may be used.

In forming the product of the present invention, it has been found that the stabilizer particles adhere to the gas-liquid interface of the pores. This occurs because the total energy of this state is lower than the surface energy of the separate liquid-vapour and liquid-solid state. The presence of the particles around the periphery of the pores tends to stabilize the expanded lightweight material.

The products of this invention are capable of wide industrial application where lightweight metal castings shaped to close dimensional tolerances are required, e.g. parts for the automotive industry.

BRIEF DESCRIPTION OF THE DRAWINGS

Methods and apparatus for performing the present invention will now be more particularly described by way of example with reference to the accompanying drawings in which.

DESCRIPTION OF THE PREFERRED EMBODIMENTS

Figure 1:
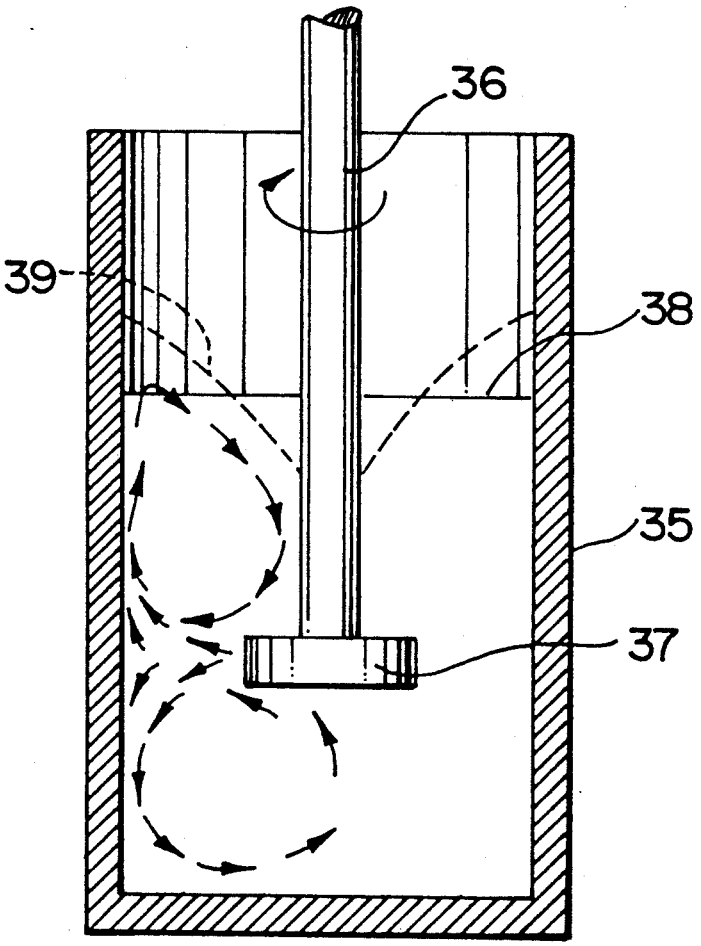
FIG. 1 illustrates schematically an apparatus for carrying out the vortex mixing.

In the system shown in FIG. 1, a crucible 35 contains a rotatable shaft 36 with an impeller 37. In this particular embodiment, the crucible has a diameter of 32 cm and the blades of the impeller are rectangular, measuring about 76 mm×127 mm.

In operation, a molten metal composite is filled to the level 38. The impeller is then rotated at high speed to form a vortex 39. A blanket of gas is provided on the surface of the melt vortex, and the gas is drawn into the melt to eventually form an expanded porous material. The expansion is continued until the crucible is substantially filled. At that point, the mixing is stopped and the material is removed from the crucible for forming into desired shapes.

The following non-limiting examples illustrate certain preferred embodiments of the invention.

EXAMPLE 1

Using the crucible of FIG. 1, A 356 aluminum alloy was melted and 15% by volume of silicon carbide powder was added thereto. The crucible was then evacuated and an atmosphere of argon was provided on the surface of the melt.

Figure 2:
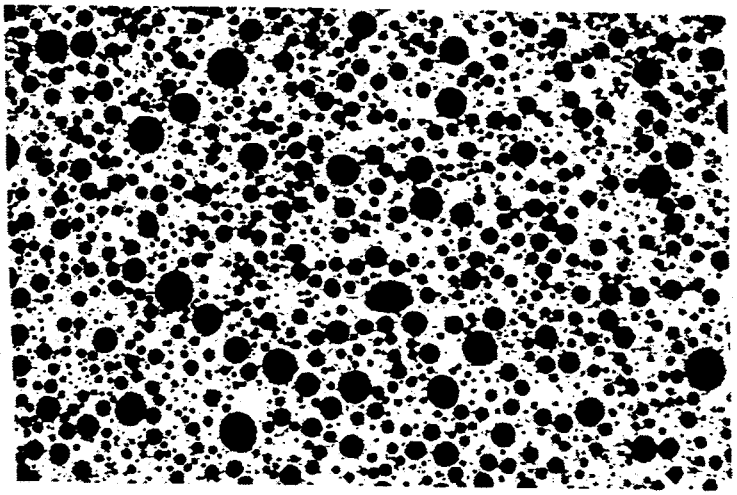
FIG. 2 shows at 10x magnification a cross-section through a cast lightweight aluminum composite of the invention.
Figure 3:
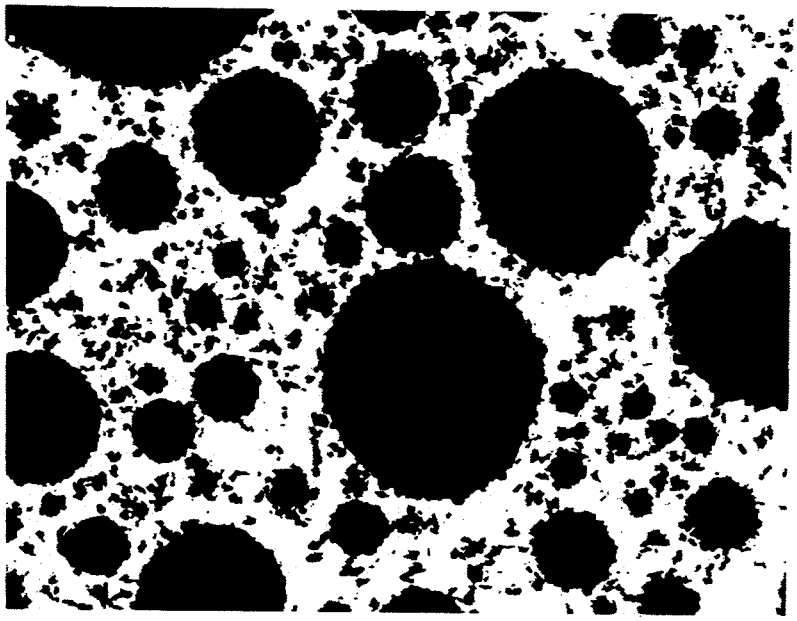
FIG. 3 is a photomicrograph of the material of FIG. 2 at 100× magnification.

With the molten metal composite at a temperature of 650°-700° C., the impeller was rotated at 900 rpm. After 10 minutes of mixing, the composite melt started to expand. When the expansion reached the top of the crucible, the impeller was stopped and samples of the expanded, viscous molten material were collected and cast in a sample mould. The cast was sectioned and examined microscopically and the results are shown in the photomicrographs of FIGS. 2 and 3.

This expanded material was found to have pores which were very small, spherical-shaped and quite evenly distributed. The bulk density of the expanded metal composite material was in the range of 1-1.5 g/cc, with an average pore size of about 250 microns and an average spacing between pores of about 100 microns.

EXAMPLE 2

Using the apparatus of FIG. 1, a composite of 6061 aluminum alloy reinforced with 15% by volume of alumina powder was melted. With the molten metal composite at a temperature of 710° C., the impeller was rotated at 800 rpm. After 15 minutes of mixing, the composite melt started to expand and form a viscous molten material. This expanded, viscous molten material was cast in a sample mold. The solidified cast was sectioned and examined microscopically and was found to have an appearance similar to that of the photomicrographs of FIGS. 2 and 3.

EXAMPLE 3

Again using the apparatus of FIG. 1, a composite of an aluminum alloy containing 8.5% by weight of silicon and 10 volume percent silicon carbide powder was melted.

Figure 4:
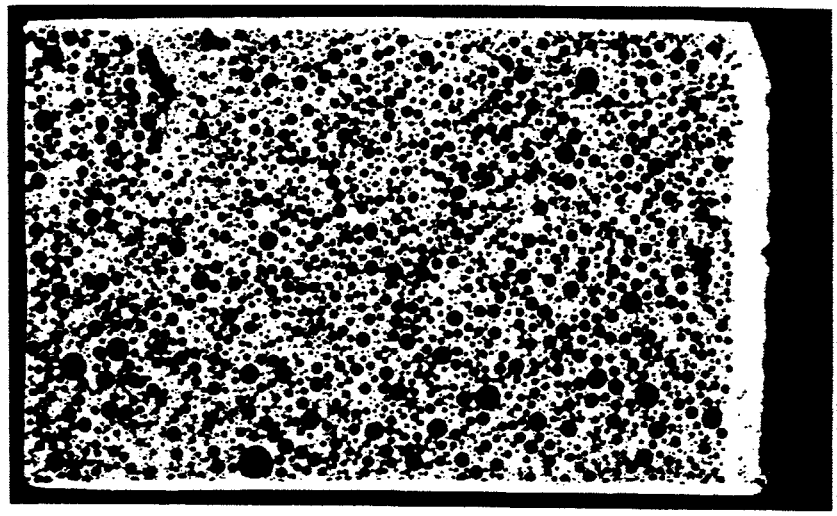
FIG. 4 shows at 4× magnification a cross-section through a further cast lightweight aluminum composite according to the invention.
Figure 5:
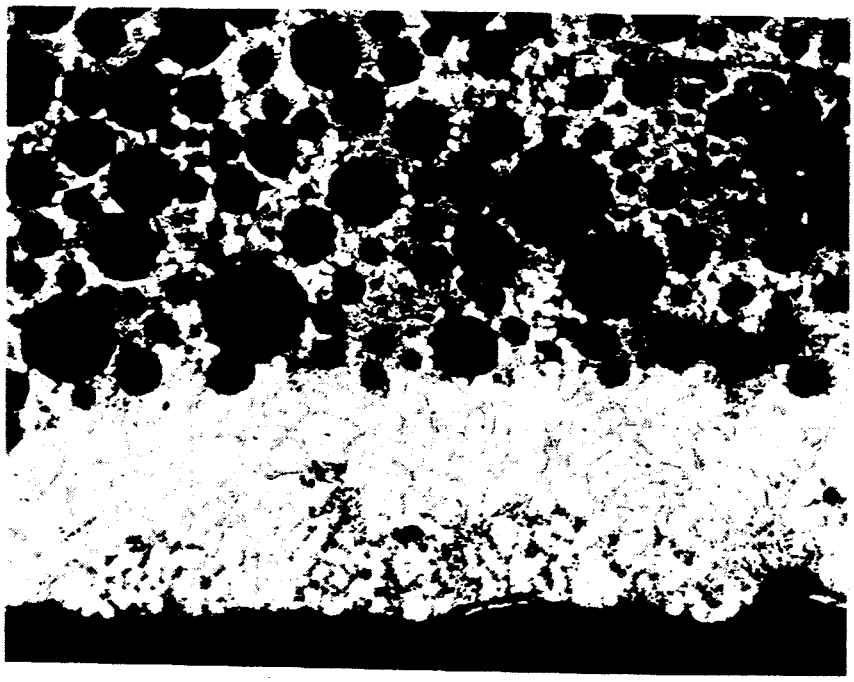
FIG. 5 shows at 25× magnification a cross-section throught part of the product of FIG. 4.

With the molten metal composite at a temperature of 680° C., the impeller was rotated at 1,000 rpm. After about 15 minutes of mixing, the composite melt started to expand. When the material had completed its expansion, the expanded, viscous molten material was cast in a ceramic mold having dimensions of 20 cm×20 cm×2.5 cm. A solidified lightweight plate was formed in about 10 minutes and this was sectioned and examined microscopically. A 4× magnification is shown in FIG. 4 and it can be seen that evenly distributed spherical shaped pores are present which were not destroyed during the casting operation and which did not coalesce during the slow cooling. From FIG. 5, which is a 25× magnification, it can be seen that a molten metal layer is formed at the bottom as a result of drainage, having a thickness of only about 1 mm.

We claim:

1. A process for producing a lightweight gas-metal composite containing isolated particle-stabilized pores, comprising the steps of:

heating a composite of a metal matrix and finely divided solid stabilizer particles above the liquidus temperature of the metal matrix to form a molten metal composite;

mixing the molten metal composite whereby a vortex is formed and continuing the mixing while drawing a gas into the molten composite by way of the vortex until an expanded, viscous molten composite material is formed; and cooling the expanded material below the solidus temperature of the melt to form a lightweight solid metal product having distributed therethrough a plurality of small isolated, particle-stabilized pores.

2. A process according to claim 1, wherein the stabilizer particles are present in the metal matrix composite in an amount of less than 25% by volume.

3. A process according to claim 2, wherein the stabilizer particles have sizes in the range of about 0.1 to 50 μm.

4. A process according to claim 3, wherein the stabilizer particles have sizes in the range of about 0.5 to 25 μm and are present in the composite in an amount of 5 to 15% by volume.

5. A process according to claim 3, wherein the stabilizer particles are ceramic or intermetallic particles.

6. A process according to claim 3, wherein the stabilizer particles are metal oxides, carbides, nitrides or borides.

7. A process according to claim 3, wherein the stabilizer particles are selected from the group consisting of alumina, titanium diboride, zirconia, silicon carbide and silicon nitride.

8. A process according to claim 3, wherein the mixing is continued until the expanded molten metal composite has a pasty or viscous consistency.

9. A process according to claim 1, wherein the expanded, viscous molten composite material is formed into a shaped, lightweight metal product.

10. A process according to claim 1, wherein the solid metal product is remelted and formed into a shaped, lightweight metal product.

11. A process according to claims 9 or 10, wherein the forming comprises die-casting or thixotropic shaping.

12. A process according to claim 11 wherein the thixotropic shaping is thixo-extrusion or thixo-forging.

13. A process according to claim 1, wherein the metal matrix is aluminum or an alloy thereof.

14. A stabilized, lightweight metal body, comprising:

a metal matrix having finely divided solid stabilizer particles dispersed therethrough; and said body also having dispersed therethrough a plurality of closed and isolated pores, with the stabilizer particles contained in the matrix being concentrated adjacent the interfaces between the matrix metal and the closed pores.

15. A metal body according to claim 14, wherein the pores are spherical and have sizes in the range of 10–500 microns.

16. A metal body according to claim 15, wherein the pores are spaced from each other by an average distance of about 50 to 100 microns.

17. A metal body according to claim 16, wherein the metal body is a shaped body having smooth outer faces and a core with said spaced pores.

18. A metal body according to claim 16, wherein the stabilizer particles are present in the metal matrix composite in an amount of less than 25% by volume.

19. A metal body according to claim 18, wherein the stabilizer particles have sizes in the range of about 0.1 to 50 microns.

20. A metal body according to claim 19, wherein the stabilizer particles are ceramic or intermetallic particles.

21. A metal body according to claim 20, wherein the metal matrix is aluminium or an alloy thereof.

22. A metal body according to claim 21, wherein the stabilizer particles are metal oxides, carbides, nitrides or borides.

23. A metal body according to claim 14, having a relative density of from about 0.3 to about 1.

* * * * *